US006241208B1

(12) United States Patent
Lin

(10) Patent No.: US 6,241,208 B1
(45) Date of Patent: Jun. 5, 2001

(54) STRUCTURE FOR MOUNTING A HAND TOOL IN A HANGING PACKAGE

(76) Inventor: Jinn-Juang Lin, P.O. Box 82-144, Taipei (TW)

( * ) Notice: Subject to any disclaimer, the term of this patent is extended or adjusted under 35 U.S.C. 154(b) by 0 days.

(21) Appl. No.: 09/553,766

(22) Filed: Apr. 21, 2000

(51) Int. Cl.[7] ..... A47F 5/00

(52) U.S. Cl. ..... 248/309.1; 248/689; 248/690; 248/686; 248/682; 248/312; 248/221.11; 211/70.1; 211/70.6; 211/70.7; 206/349; 206/461; 206/470; 206/477; 206/481

(58) Field of Search ..... 248/309.1, 689, 248/690, 692, 686, 682, 693, 312, 221.11, 220.31, 316.1, 111; 211/70.1, 70.6, 70.7; 206/349, 461, 470, 477, 481, 488, 756

(56) References Cited

U.S. PATENT DOCUMENTS 4,634,005 * 1/1987 Kulzer et al. ..... 206/477
5,713,467 * 2/1998 Kao ..... 206/349
5,906,350 * 5/1999 Kao ..... 248/688
5,941,386 * 8/1999 Hu et al. ..... 206/376
5,988,381 * 11/1999 Ling ..... 206/349
5,996,817 * 12/1999 Kao ..... 211/70.6
6,076,669 * 6/2000 Ling ..... 206/349
6,164,463 * 12/2000 Lee ..... 211/70.6

* cited by examiner

*Primary Examiner*—Leslie A. Braun
*Assistant Examiner*—A. Joseph Wujciak
(74) *Attorney, Agent, or Firm*—A & J

(57) ABSTRACT

A structure for mounting a hand tool in a hanging package includes a base plate, a semi-circular member having a neck connecting the base plate to the semi-circular member, the semi-circular member being provided with two tubular members at two ends each having an inwardly extending arm, two pins fixedly arranged two opposite sides of the base plate and adapted to engage with holes of the two tubular members, and a cardboard formed with an elongated slot and two holes at two sides of the elongated slot, whereby the base plate is first mounted on a back side of the cardboard with the two pins extending through the holes and then the semi-circular member is inserted through the elongated slot to a front side of the cardboard

2 Claims, 8 Drawing Sheets

STRUCTURE FOR MOUNTING A HAND TOOL IN A HANGING PACKAGE

BACKGROUND OF THE INVENTION

1. Field of the Invention

This invention is related to a structure for mounting a hand tool in a hanging package and in particular to one which can be used for keeping the position of various kinds of hand tools in hanging packages.

2. Description of the Prior Art

As shown in FIGS. 1A and B, the conventional hanging package includes a hanging cardboard 1 and a plastic covering 2 mounted on the hanging cardboard 1. However, the plastic covering 2 must be of a shape configured to receive a particular hand tool, so that it is necessary to prepare a large number of different coverings 2 in order to pack various different kinds of hand tools thereby making it necessary to prepare a number of molds for forming the coverings and therefore increasing the manufacturing cost of the hanging package.

Therefore, it is an object of the present invention to provide a hanging package with a structure capable of mounting various kinds of hand tools.

SUMMARY OF THE INVENTION

This invention is related to a structure for mounting a hand tool in a hanging package and in particular to one which can be used for keeping the position of various kinds of hand tools in hanging packages.

According to a preferred embodiment of the present invention, a structure for mounting a hand tool in a hanging package includes a base plate, a semi-circular member having a neck connecting the base plate to the semi-circular member, the semi-circular member being provided with two tubular members at two ends each having an inwardly extending arm, two pins fixedly arranged two opposite sides of the base plate and adapted to engage with holes of the two tubular members, and a cardboard formed with an elongated slot and two holes at two sides of the elongated slot, whereby the base plate is first mounted on a back side of the cardboard with the two pins extending through the holes and then the semi-circular member is inserted through the elongated slot to a front side of the cardboard.

It is the primary object of the present invention to provide a structure for mounting a hand tool in a hanging package which has the following advantages over the prior art:

1. The present invention can be used for mounting various kinds of hand tools in a hanging package thereby making it unnecessary to prepare a number of molds for manufacturing different plastic coverings and therefore reducing the manufacturing cost.
2. The present invention can keep the hand tool firmly in the hanging package.
3. As the present invention can keep the hand tool firmly in the hanging package, it will be difficult to take the hand tool from the hanging package in a short time thereby decreasing the chance of being stolen.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1B:
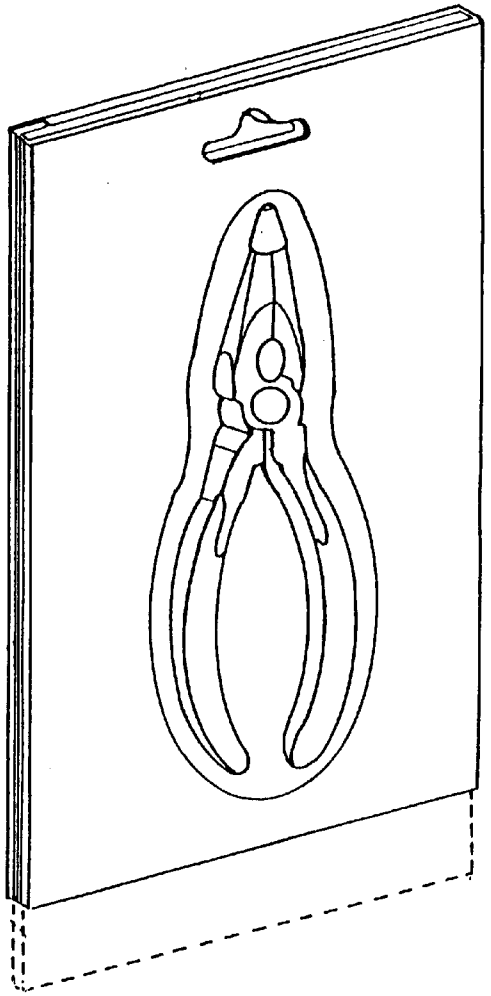
PRIOR ART FIG. 1B
FIGS. 1A and 1B illustrate a prior art hanging package.
Figure 1A:
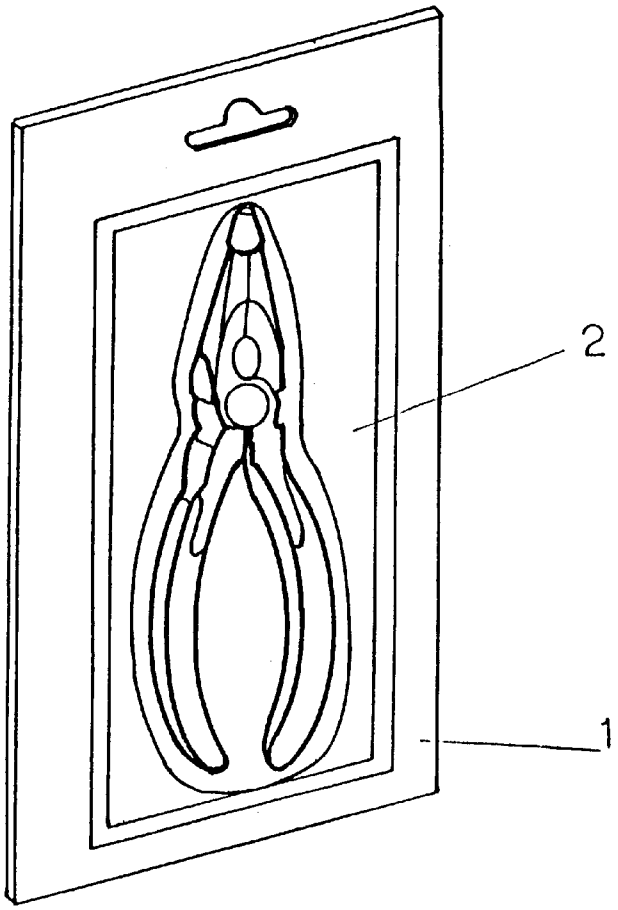
PRIOR ART FIG. 1A

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
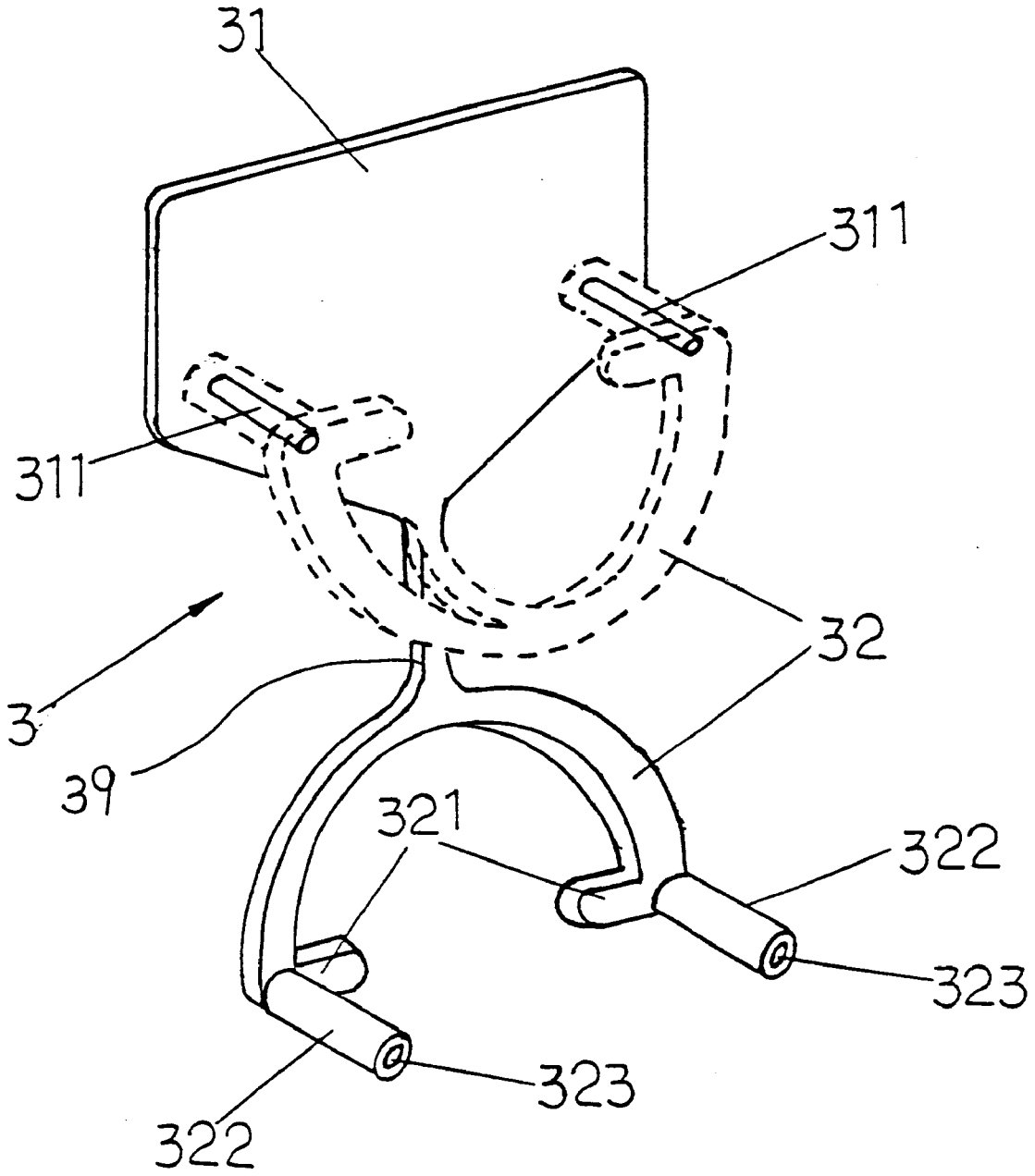
FIG. 2 is perspective view of the present invention.

With reference to the drawings and in particular to FIG. 2 thereof, the structure 3 for mounting a hand tool in a hanging package according to the present invention comprises a base plate 31 and a semi-circular member 32 having a neck 39 connecting the base plate 31 to the semi-circular member 32. The semi-circular member 32 is provided with two tubular members 322 at Two ends each having an inwardly extending arm 321. Two pins 311 are fixedly arranged two opposite sides of the base plate 31 and adapted to engage with the holes 323 of the two tubular members 322. The cardboard 1 is formed with an elongated slot 12 and two holes 11 at two sides of the elongated slot 12. The base plate 31 is first mounted on the back side of the cardboard 1 with the two pins 311 extending through the holes 11 and then the semi-circular member 32 is inserted through the elongated slot 12 to the front side of the cardboard 1.

Figure 3:
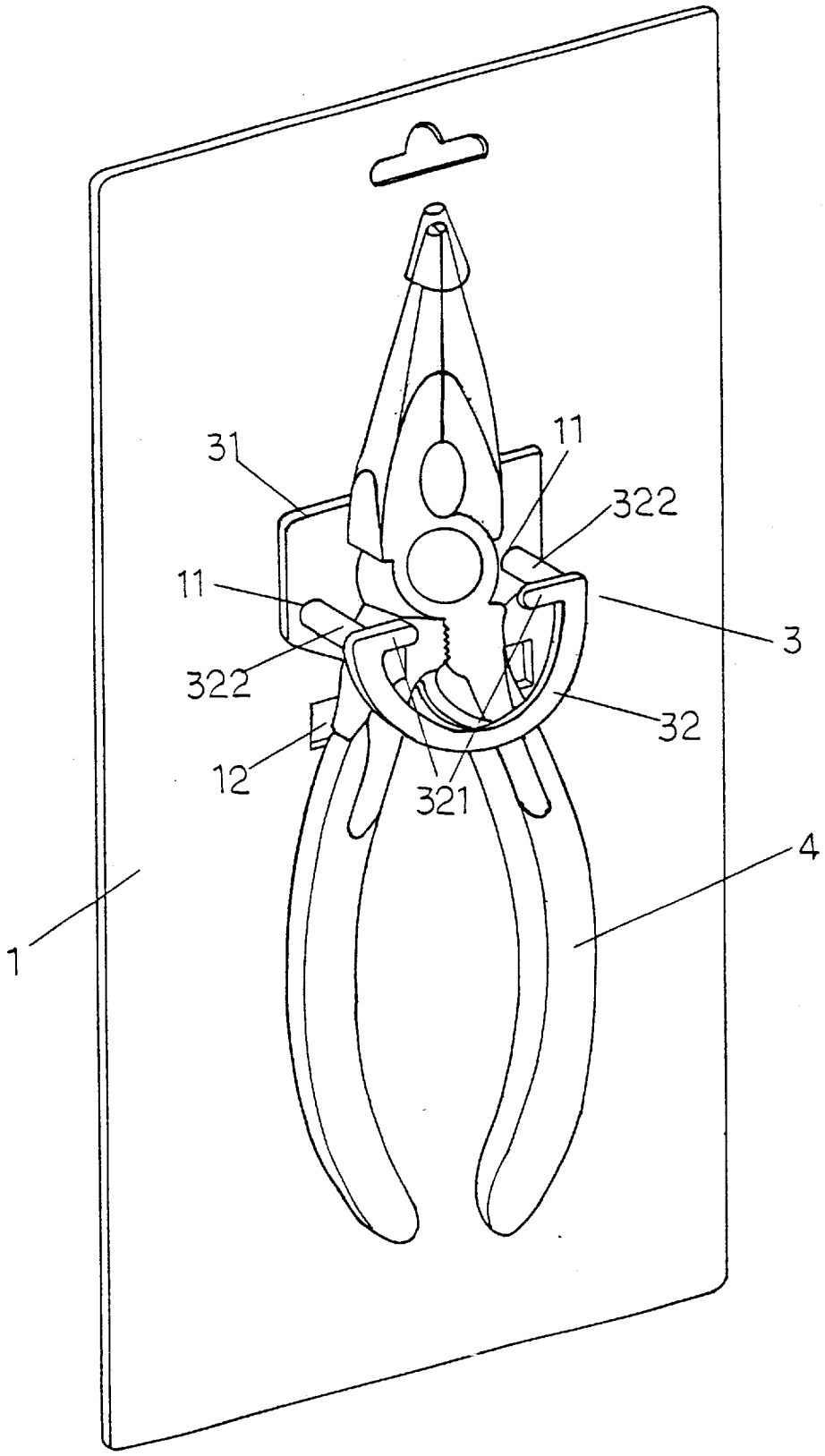
FIG. 3 is a working view of the present invention.
Figure 4:
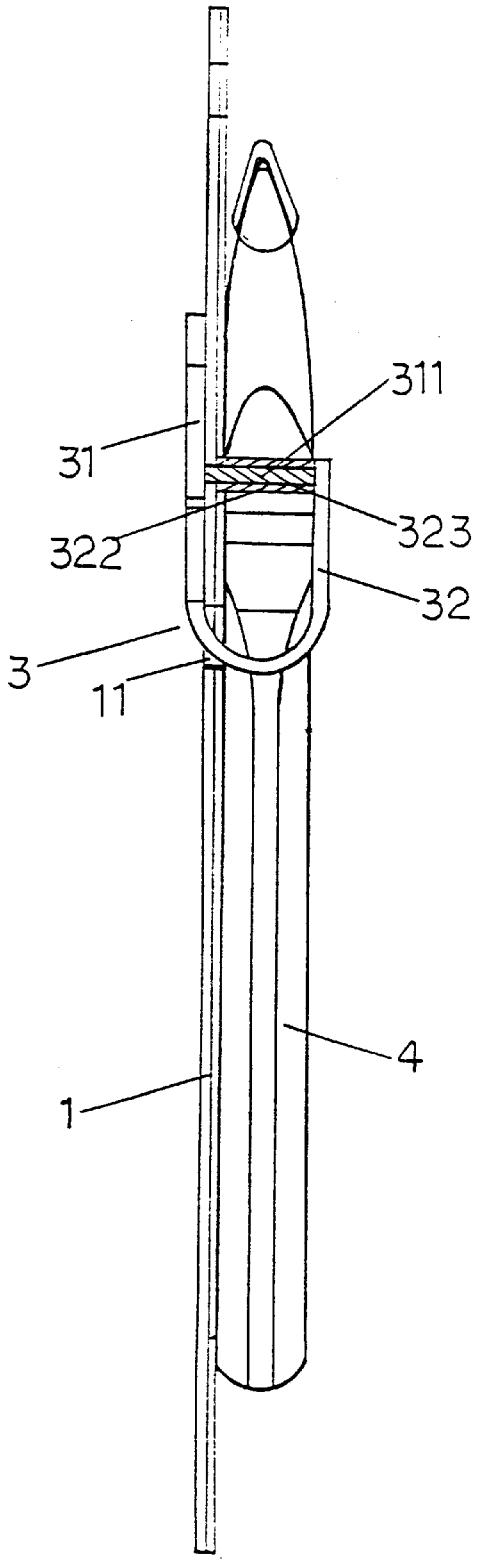
FIG. 4 is another working view of the present invention.
Figure 5:
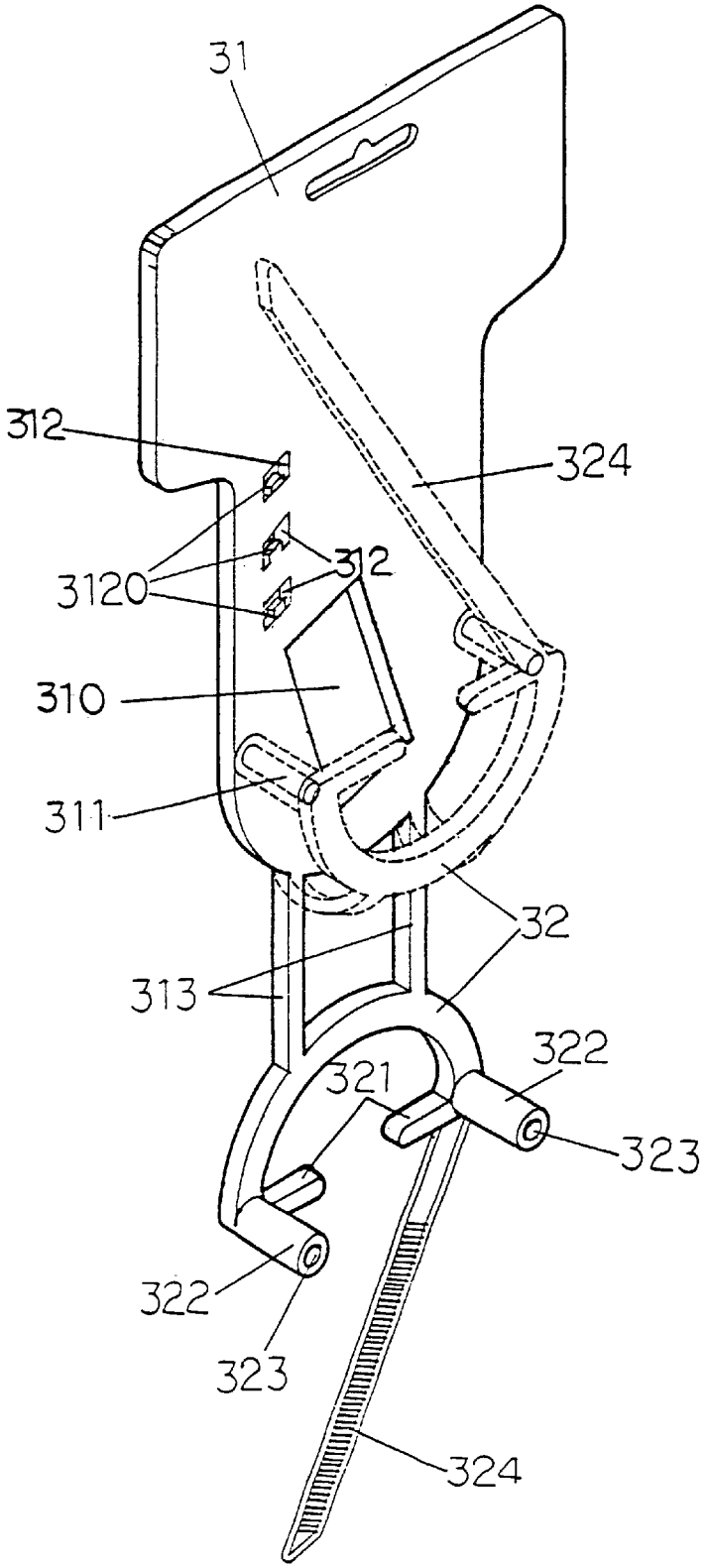
FIG. 5 is a perspective view of a second preferred embodiment according to the present invention.

Referring to FIGS. 3 and 4, when desired to mount a hand tool 4 in a hanging package according to the present invention, it is only necessary to place the hand tool 4 on the base plate 31 and then the semi-circular member 32 is bent upward so that the tubular members 322 of the semi-circular member 32 are engaged with the pins 311 thereby keeping the hand tool 4 in place.

Figure 6:
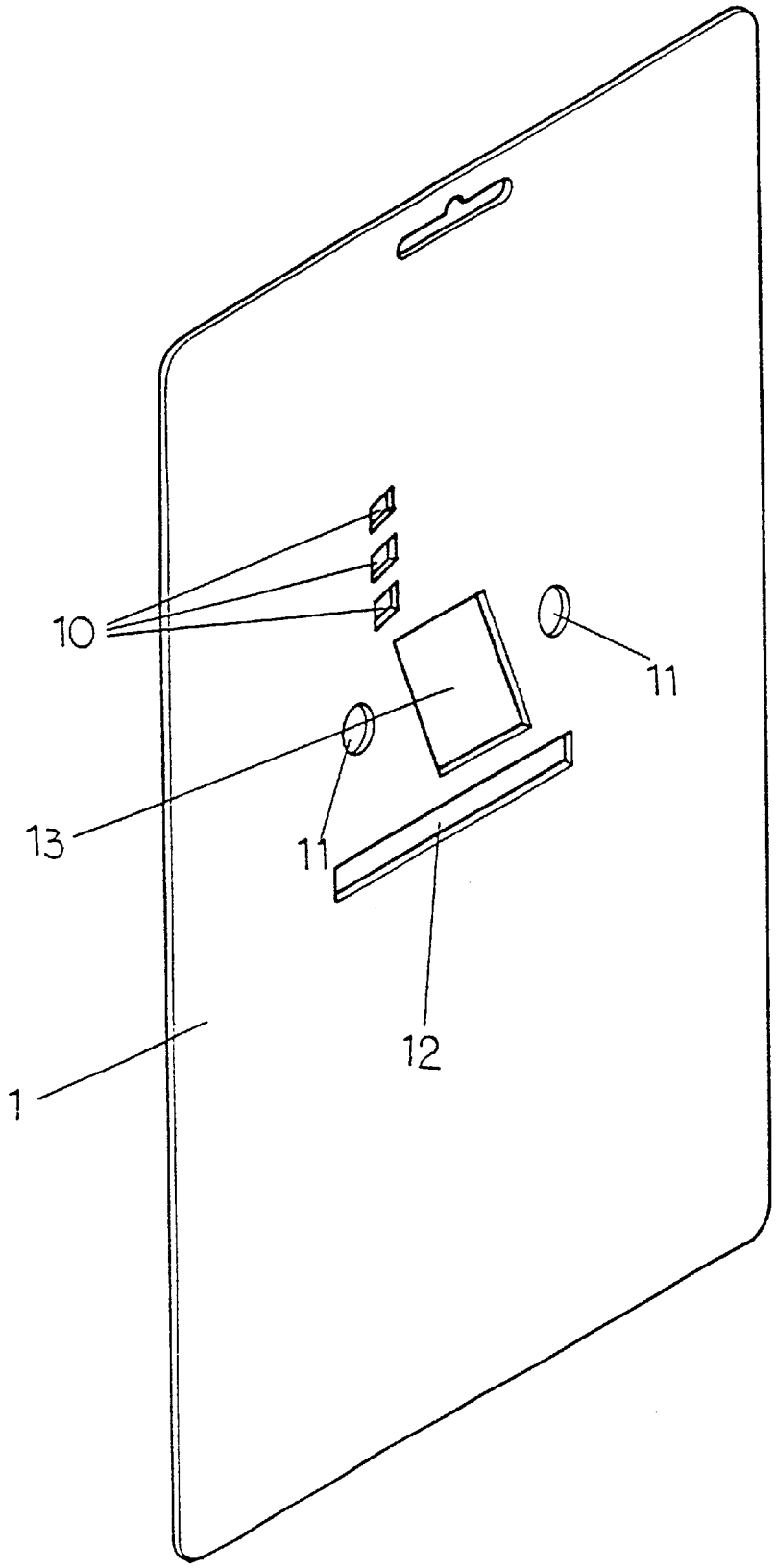
FIG. 6 is a perspective view of the cardboard of the second preferred embodiment.
Figure 7:
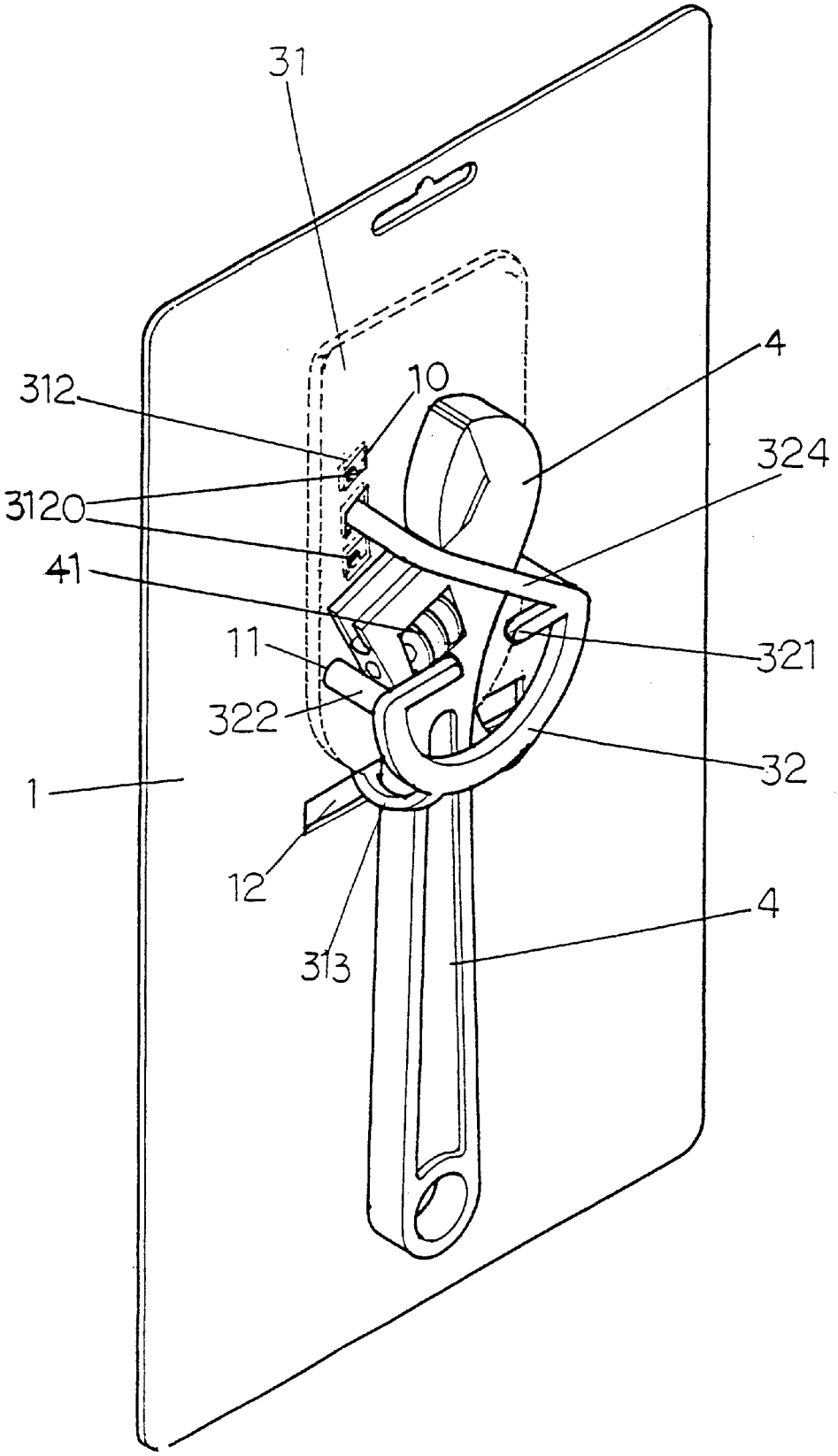
FIGS. 7 and 8 are working views of the present invention.
Figure 8:
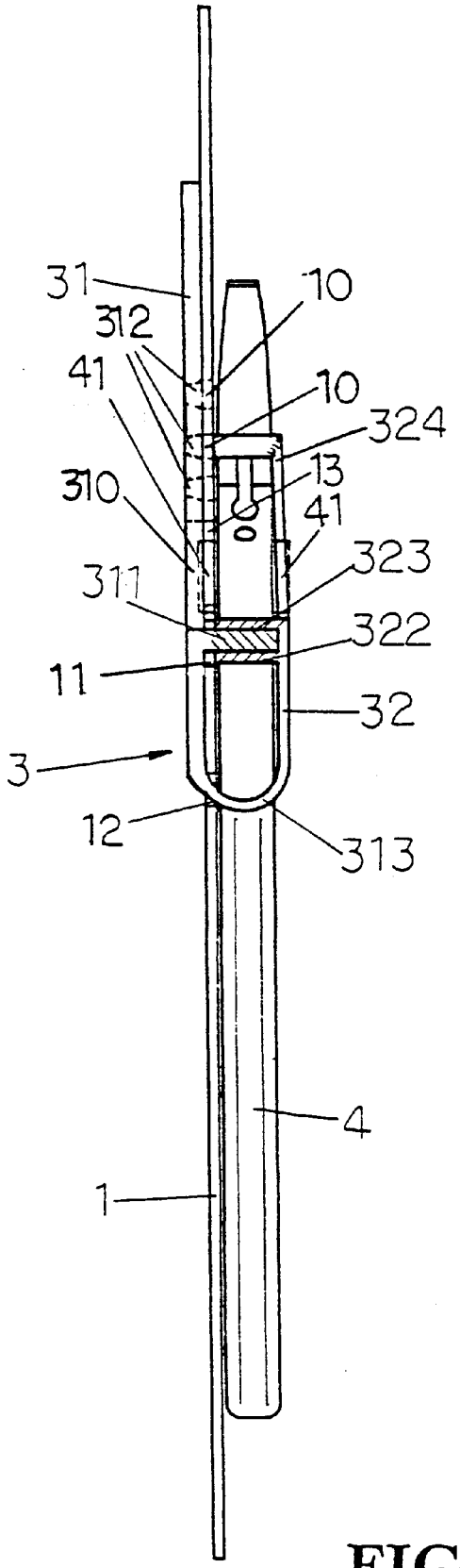

FIGS. 5, 6, 7 and 8 illustrate a second preferred embodiment of the present invention. As shown, the structure for mounting a hand tool in a hanging package according to the second preferred embodiment of the present invention comprises a base plate 31 and a semi-circular member 32 having two necks 311 connecting the base plate 31 to the semi-circular member 32. The semi-circular member 32 is provided with two tubular members 322 at two ends each having an inwardly extending arm 321. Two pins 311 are fixedly arranged two opposite sides of the base plate 31 and adapted to engage with the holes 323 of the two tubular members 322. The base plate 31 is formed with a rectangular opening 310 and three slots 312 above the rectangular opening 310. Each of the slots 312 is formed with a tooth 3120. A strap 324 with teeth thereon extends from one end of the semi-circular member 32. Referring to FIG. 6, the cardboard 1 is formed with an elongated slot 12, a rectangular opening 13 above the elongated slot 12, two circular holes 11 at two sides of the rectangular opening 13, and three slots 10 above the rectangular opening 13. The base plate 31 is first mounted on the back side of the cardboard 1 with the two pins 311 extending through the holes 11 and then the semi-circular member 32 is inserted through the elongated slot 12 to the front side of the cardboard 1.

When required to mount a hand tool 4 on a hanging package according to the present invention, it is only necessary to place the hand tool 4 on the base plate 31 and then the semi-circular member 32 is bent upward so that the tubular members 322 of the semi-circular member 32 are engaged with the pins 311 thereby keeping the hand tool 4 in place. Thereafter, the strap 324 is inserted into one of the slots 312 so that the strap 324 is engaged with the tooth 3120 of the slot 312 thus strengthening the engagement between the hand tool 4 with the cardboard 1.

Accordingly, the present invention has the following advantages over the prior art:

4. The present invention can be used for mounting various kinds of hand tools in a hanging package thereby making it unnecessary to prepare a number of molds for manufacturing different plastic coverings and therefore reducing the manufacturing cost.
5. The present invention can keep the hand tool firmly in the hanging package.
6. As the present invention can keep the hand tool firmly in the hanging package, it will be difficult to take the hand tool from the hanging package in a short time thereby decreasing the chance of being stolen.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure for mounting a hand tool in a hanging package comprising:

a base plate;

a semi-circular member having a neck connecting said base plate to said semi-circular member, said semi-circular member being provided with two tubular members at two ends each having an inwardly extending arm;

two pins fixedly arranged two opposite sides of said base plate and adapted to engage with holes of said two tubular members; and a cardboard formed with an elongated slot and two holes at two sides of said elongated slot;

whereby said base plate is first mounted on a back side of said cardboard with said two pins extending through said holes and then said semi-circular member is inserted through said elongated slot to a front side of said cardboard.

2. A structure for mounting a hand tool in a hanging package comprising:

a base plate formed with a rectangular opening and three slots above said rectangular opening, each of said slots being formed with a tooth;

a semi-circular member having two necks connecting said base plate to said semi-circular member, said semi-circular member being provided with two tubular members at two ends each having an inwardly extending aim;

a strap with teeth thereon extending from one end of said semi-circular member and engageable with said slots of said base plate;

two pins fixedly arranged two opposite sides of said base plate and adapted to engage with holes of said two tubular members; and a cardboard formed with an elongated slot, a rectangular opening above said elongated slot, two circular holes at two sides of said rectangular opening, and three slots above said rectangular opening 13;

whereby said base plate is first mounted on a back side of said cardboard with said two pins extending through said holes, said semi-circular member is inserted through said elongated slot to a front side of said cardboard and said strap is inserted into one of said slots of said base plate to fix a hand tool on said cardboard.

* * * * *